US006061836A

United States Patent [19]

Peters

[11] Patent Number: 6,061,836

[45] Date of Patent: May 16, 2000

[54] SLIP-ON, ELASTIC, FABRIC COVER FOR HARD HATS AND THE LIKE

[76] Inventor: Randall G. Peters, 1020 S. 700 St. W., Salt Lake City, Utah 84104

[21] Appl. No.: 09/179,522

[22] Filed: Oct. 28, 1998

[51] Int. Cl.[7] ..... A42B 1/18

[52] U.S. Cl. ..... 2/175.6; 2/8

[58] Field of Search ..... 2/171.1, 175.6, 2/5, 7, 8, 171, 174, 200.1, 410

[56] References Cited

U.S. PATENT DOCUMENTS

| | | | |
|---|---|---|---|
| D. 297,066 | 8/1988 | Schonwetter et al. | D2/260 |
| D. 297,067 | 8/1988 | Schonwetter et al. | D2/260 |
| D. 299,180 | 1/1989 | Gentes | D2/260 |
| D. 374,972 | 10/1996 | Nelson et al. | D2/866 |
| 3,155,981 | 11/1964 | McKissick | 2/3 |
| 4,345,336 | 8/1982 | Plastino | 2/171.1 |
| 4,517,685 | 5/1985 | Lesley | 2/171 |
| 4,776,043 | 10/1988 | Coleman | 2/199 |
| 5,359,734 | 11/1994 | Rathburn | 2/195.1 |
| 5,481,759 | 1/1996 | Rinaldi | 2/171.1 |

*Primary Examiner*—Bibhu Mohanty
*Attorney, Agent, or Firm*—John D. Gugliotta

[57] ABSTRACT

A slip-on, elastic, fabric cover for hard hats and the like is disclosed, designed for use with conventional hard hats and the like, constructed of an elastic material, the cover stretches to fit over and contracts to fit the contour of a hard hat structure. At least one stiffened segment is located on the main body. The stiffened segment is designed to permit a visual media, such as a logo or company name, to be imprinted thereon, using imprinting techniques, such as silk screen and the like, without distortion of the image occurring when the main body is subsequently stretched over the hard hat.

10 Claims, 3 Drawing Sheets

SLIP-ON, ELASTIC, FABRIC COVER FOR HARD HATS AND THE LIKE

RELATED APPLICATIONS AND DISCLOSURES

The present invention is a continuation of the Disclosure Document filed on Mar. 16, 1998. There were no previously filed, nor any copending applications anywhere in the world.

BACKGROUND OF THE INVENTION

1. Field of the Invention

The present invention relates generally to safety helmet and hard hat covers, and, more particularly, to slip-on, elastic, fabric cover for hard hats and the like.

2. Description of the Related Art

There are many occupations that require the use of protective head gear, commonly referred to as hard hats, on the part of their workers. Taking advantage of this fact, many employers, vendors and equipment suppliers have taken on the additional expense of decorating these hard hats with company names and logos in order to create a business identity, or perhaps some advertising value.

Furthermore, as with most worn articles, individual stylistic and artistic tastes and preferences have resulted in these workers decorating their hard hats in a variety of manners. Many workers use paint, markers and stickers to decorate their hard hat in a unique and individualized manner.

Accordingly, there is a place in the market for items that can be used to either individualize or provide an advertising identity to hard hats in an effective, economic manner.

In the related art, several hat and helmet covers are disclosed. U.S. Pat. No. D 374,972, issued in the name of Nelson et al., discloses a design for a combined helmet cover and visor.

U.S. Pat. No. D 299,180, issued in the name of Gentes, discloses a design for a bicyclist's helmet cover.

U.S. Pat. No. D297,067, and U.S. Pat. No. D 297,066, both issued in the name of Schonwetter et al., disclose a design for a present invention.

U.S. Pat. No. 5,359,734, issued in the name of Rathburn, discloses a hat with interchangeable display panels.

U.S. Pat. No. 4,776,043, issued in the name of Coleman, discloses a hat with an interchangeable logo on it. The logos are connected to the hat via Velcro, and permit the user to make the same printed statement about a variety of people, teams, organizations, etc.

U.S. Pat. No. 3,155,981, issued in the name of McKissick et al., disclosing a football helmet with a logo on it.

One problem not adequately addressed by the prior art is that of printing logos or other visual media onto a fabric of a hard hat cover and the like, while simultaneously reducing distortion of the image once the hard hat cover is placed on the hard hat or the like. Usually a printed image is placed on the material prior to placement of the cover on the hat. Placement of the image on the cover while the cover is on the hat is impractical, since hard hats come is a variety of sizes and configurations, and use of the cover would be limited to the hard hat on which the cover was placed when the image was printed thereon.

Deformation of the image occurs post-application, when the cover is stretched into place over the hat and the like, creating the necessary snug fit to ensure secure attachment thereto. What is needed is a hard hat cover that is designed to have images, logos and the like placed thereon, post manufacture, without the image distorting once the hard hat cover is placed on the hard hat.

A search of the prior art did not disclose any patents that read directly on the claims of the instant invention. Consequently, a need has been felt for providing an apparatus and method which overcomes the problems cited above.

SUMMARY OF THE INVENTION

It is therefore an object of the present invention to provide an improved slip-on, elastic, fabric cover for hard hats and the like that is designed to have images, logos and the like placed thereon, post manufacture, without image distortion occurring once the hard hat cover is placed on the hard hat and the like.

Briefly described according to one embodiment of the present invention, a slip-on, elastic, fabric cover for hard hats and the like is disclosed, designed for use with conventional hard hats and the like. The present invention consists of a main body, constructed of an elastic material that stretches to fit over and contracts to fit the contour of a hard hat structure. Available in a variety of colors and patterns, the main body provides an effective, low cost method by which one can customize his or her hard hat, or add a company name or logo in order to create a business identity. It is envisioned that the main body is comprised of a flame retardant material. A main body retention means is attached to the ends of the main body, so as to form a generally enclosed structure.

At least one stiffened segment is located on the main body. The stiffened segment is designed to permit a visual media, such as a logo or company name, to be imprinted thereon, using imprinting techniques, such as silk screen and the like, without distortion of the image occurring when the main body is subsequently stretched over the hard hat. As such, the stiffened segment is designed to reduce the elasticity of that portion of the main body to a sufficient degree to reduce noticeable distortion of the visual media once the main body is applied to the hard hat.

It is envisioned that the stiffened segment may take on a variety of sizes and configurations, depending on the cross sectional area needed to place a particular visual media on the main body.

It is envisioned that the main body is washable. It is envisioned that a reflective coating be placed on the main body, thus permitting the present invention to be used by construction workers and the like, for safety purposes, as is required by applicable state and federal regulations.

In an alternate embodiment of the present invention, the stiffened segment is replaced with a patch attachment means, such as hook and loop fastener. The patch attachment means is positioned in the same position as the stiffened segment was positioned. The patch attachment means permits patches, conceivably containing company logos and the like, to be releasably secured to the main body.

It is another object of the present invention to provide a device that conforms to the contour of a hard hat and the like.

It is another object of the present invention to provide a device that is self-securing.

It is another object of the present invention to provide a device that can be easily slid on and off the hard hat.

It is another object of the present invention to provide a device that is washable.

It is another object of the present invention to provide a device that comes in a variety of colors and patterns, to suit workers' tastes and facilitate individuality.

It is another object of the present invention to provide a device that utilizes printed or embroidered text or logos, thus being used for advertising purposes or to promote company identification.

DESCRIPTIVE KEY

10 slip-on, elastic, fabric cover for hard hats and the like
20 hard hat and the like
30 main body
40 pattern
50 visual media
55 main body retention means
60 stiffened segment
70 reflective coating
80 patch attachment means
90 patch

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 1 is a front perspective view of the preferred embodiment of slip-on, elastic, fabric cover for hard hats and the like 10, in use with a hard hat or the like;

DESCRIPTION OF THE PREFERRED EMBODIMENTS

The best mode for carrying out the invention is presented in terms of its preferred embodiment, herein depicted within the FIGS. 1 through 5.

1. Detailed Description of the Figures

Figure 1:
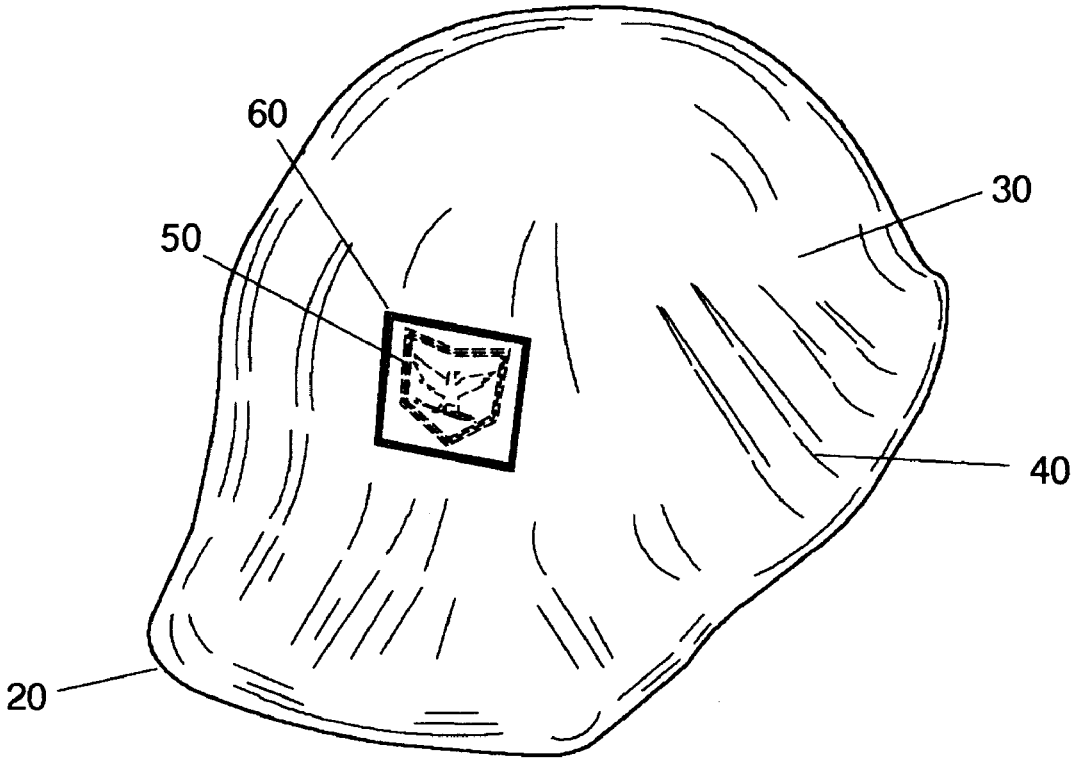

Referring now to FIG. 1, a slip-on, elastic, fabric cover for hard hats and the like 10 is shown, according to the present invention, designed for use with conventional hard hats 20 and the like.

Figure 2:
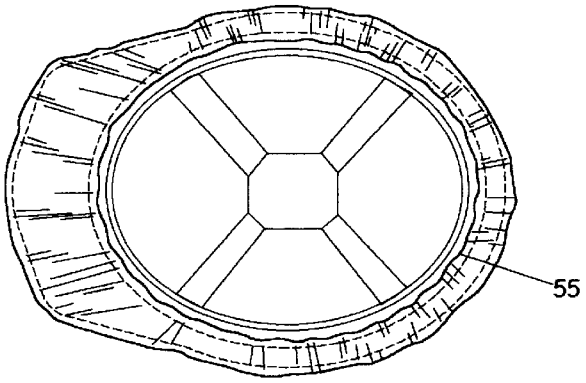
FIG. 2 is a bottom view thereof.

Referring now to FIGS. 1 and 2, the present invention comprises a main body 30, constructed of an elastic material that stretches to fit over and contracts to fit the contour of a hard hat 20 structure. Available in a variety of colors and patterns 40, the main body 30 provides an effective, low cost method by which one can customize his or her hard hat 20, perhaps adding a visual media 50, such as a company name or logo in order to create a business identity. It is envisioned that the main body 30 is comprised of a flame retardant material.

Figure 3:
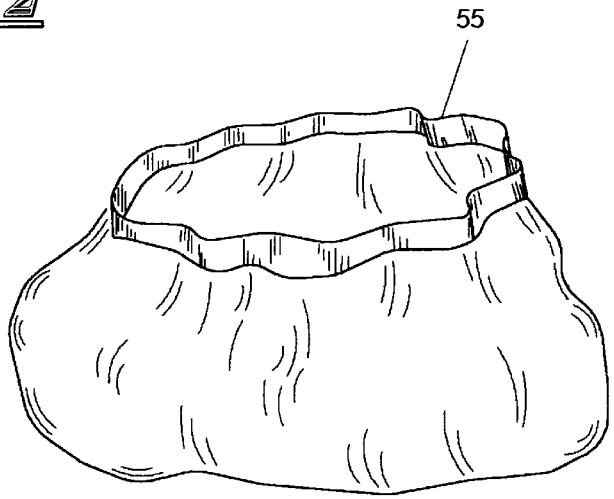
FIG. 3 is an elevational view of the main body.

Referring now to FIGS. 2 and 3, a main body retention means 55 is attached to the ends of the main body 30, so as to form a generally enclosed structure. For purposes of disclosure, this main body retention means 55 is depicted as an elastic band.

Figure 4:
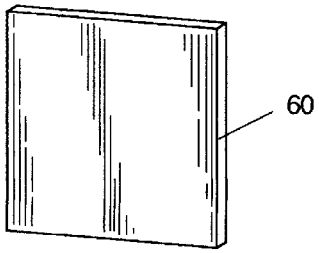
FIG. 4 is an enlarged view of the stiffened segment.

Referring now to FIGS. 1 and 4, at least one stiffened segment is located on the main body 30. The stiffened segment 60 is designed to permit a visual media 50, such as a logo or company name, to be imprinted thereon, using imprinting techniques, such as silk screen and the like, without distortion of the image occurring when the main body 30 is subsequently stretched over the hard hat 20. As such, the stiffened segment 60 is designed to reduce the elasticity of that portion of the main body 30 to a sufficient degree to reduce noticeable distortion of the visual media 50 once the main body 30 is placed over and onto the hard hat 20.

It is envisioned that the stiffened segment 60 may be formed by any of several stiffening means known in the manufacturing industry, such as impregnating the fibers of the main body 30, hard drying glue or adhesive, etc.

It is envisioned that the stiffened segment 60 may take on a variety of sizes and configurations, depending on the cross sectional area needed to place a particular visual media 50 on the main body 30.

Figure 5:
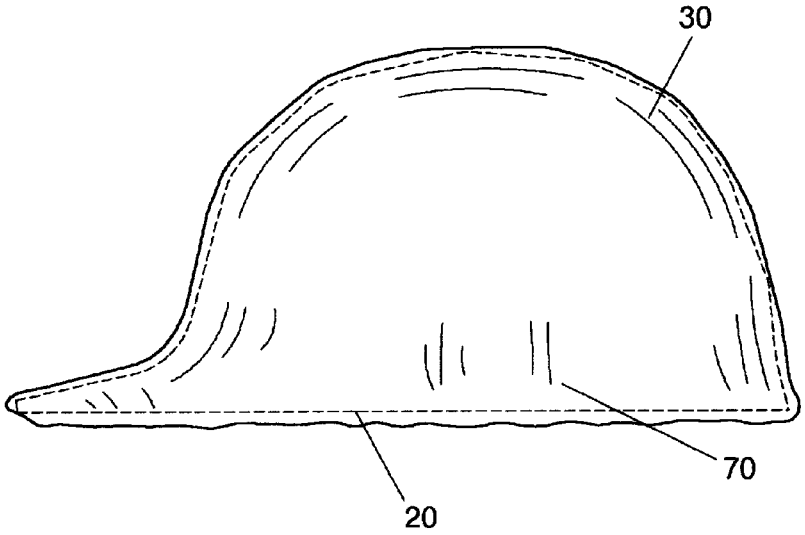
FIG. 5 is a left side view of the present invention in-use.

Referring now to FIG. 5, it is envisioned that the main body 30 is washable. It is also envisioned that a reflective coating 70 is located on the main body 30, thus permitting the present invention to be used by construction workers and the like, for safety purposes, as is required by applicable state and federal regulations.

Figure 6:
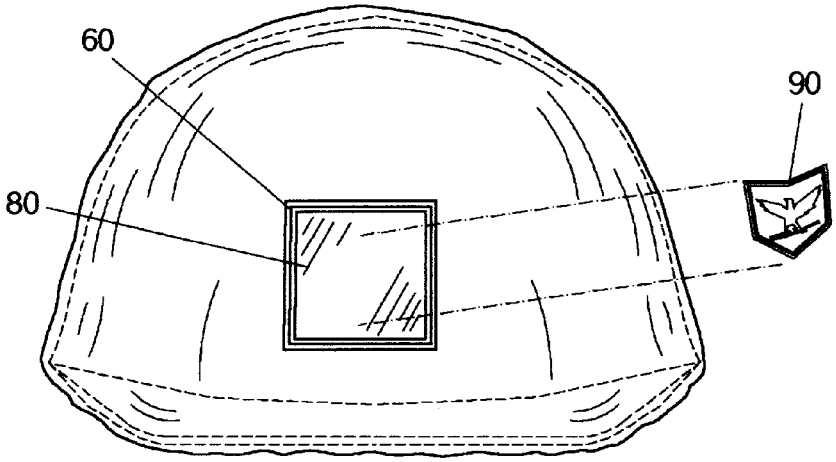
FIG. 6 is a front perspective view of an alternate embodiment of the present invention.

Referring now to FIG. 6, in an alternate embodiment of the present invention, a patch attachment means 80 is affixed to the stiffened segment 60. The patch attachment means 80 permits patches 90, conceivably containing company logos and the like, and of varying sizes and configurations, to be releasably secured to the main body 30. For purposes of disclosure, these patch attachment means are depicted as comprised of hook and loop fastener.

It is envisioned that other styles and configurations of the main body 30, stiffened segment 60, reflective coating 70 and patch attachment means 80 can be easily incorporated into the teachings of the present invention, and only one particular configuration shall be shown and described for purposes of clarity and disclosure and not by way of limitation of scope.

2. Operation of the Preferred Embodiment

To use the present invention, the main body 30 is cut from materials commonly used in the manufacturing industry. A stiffened segment 60 is then formed on the main body 30. The user then imprints the visual media 50 onto the stiffened segment 60, and wait for the visual media 50 to dry. Finally, the user places the main body 30 on the hard hat 20 or the like.

The foregoing description is included to illustrate the operation of the preferred embodiment and is not meant to limit the scope of the invention. The scope of the invention is to be limited only by the following claims.

What is claimed is:

1. A slip-on, elastic, fabric cover for hard hats and the like, said hard hat cover designed for use with conventional hard hats and the like, and comprising:

a main body, constructed of an elastic material that stretches to fit over and contracts to fit the contour of a hard hat structure, said main body forming a pair or opposed ends;

main body retention means, said main body retention means attached to the ends of said main body, so as to form a generally enclosed structure;

at least one stiffened segment; and a comprising reflective coating placed on said main body, thus permitting said present invention to be used by construction workers and the like, for safety purposes, as is required by applicable state and federal regulations.

2. The hard hat cover described in claim 1, wherein said stiffened segment facilitates the imprinting of a visual media onto said main body, using imprinting techniques, without distortion of the image occurring when said main body is subsequently stretched over said hard hat.

3. The hard hat cover described in claim 1, wherein said stiffened segment is designed to reduce the elasticity of that portion of said main body to a sufficient degree to reduce noticeable distortion of said visual media once said main body is applied to said hard hat.

4. The hard hat cover described in claim 1, wherein said main body is washable.

5. The hard hat cover described in claim 1, further comprising a patch attachment means, said patch attachment means affixed to said stiffened segment and designed to permit patches, conceivably containing company logos and the like, to be releasably secured to said main body.

6. A slip-on, elastic, fabric cover for hard hats and the like, said hard hat cover designed for use with conventional hard hats and the like, and comprising:

a main body forming a pair of opposed ends, said main body constructed of an elastic material that stretches to fit over and contracts to fit the contour of a hard hat structure wherein said main body is comprised of a flame retardant material;

main body retention means, said main body retention means attached to the ends of said main body, so as to form a generally enclosed structure; and at least one stiffened segment.

7. The hard hat cover described in claim 6, wherein said stiffened segment facilitates the imprinting of a visual media onto said main body, using imprinting techniques, without distortion of the image occurring when said main body is subsequently stretched over said hard hat.

8. The hard hat cover described in claim 6, wherein said stiffened segment is designed to reduce the elasticity of that portion of said main body to a sufficient degree to reduce noticeable distortion of said visual media once said main body is applied to said hard hat.

9. The hard hat cover described in claim 6, wherein said main body is washable.

10. The hard hat cover described in claim 6, further comprising a patch attachment means, said patch attachment means affixed to said stiffened segment and designed to permit patches, conceivably containing company logos and the like, to be releasably secured to said main body.

* * * * *